United States Patent [19]

Durchenwald

[11] Patent Number: 4,915,157

[45] Date of Patent: Apr. 10, 1990

[54] CORE HANDLING APPARATUS

[75] Inventor: Larry D. Durchenwald, Cedar Falls, Iowa

[73] Assignee: Deere & Company, Moline, Ill.

[21] Appl. No.: 364,780

[22] Filed: Jun. 12, 1989

[51] Int. Cl.[4] ..... B22C 23/00

[52] U.S. Cl. ..... 164/412; 164/340; 414/908; 414/607; 269/61; 269/48.1

[58] Field of Search ..... 164/339, 340, 412; 414/908, 607, 560, 564; 269/48.1, 61

[56] References Cited

U.S. PATENT DOCUMENTS 4,526,267 7/1985 Harding et al. ..... 414/564
4,708,574 11/1987 Conbot et al. ..... 414/908

FOREIGN PATENT DOCUMENTS 2460390 7/1975 Fed. Rep. of Germany ..... 164/339

*Primary Examiner*—Richard K. Seidel
*Assistant Examiner*—Rex E. Pelto

[57] ABSTRACT

A core handling apparatus includes an upright, tubular frame adapted for being suspended from an overhead hoist. A pair of upright air cylinders are fixed to opposite sides of the frame and each includes a reciprocable rod. Upper and lower shafts are respectively rotatably mounted in upper and lower end portions of the frame. A first length of roller chain is engaged with a first sprocket mounted on the upper shaft and has its opposite ends coupled to the respective upper ends of the piston rods of the pair of cylinders while a second length of roller chain is engaged with a second sprocket mounted on the lower shaft and has its opposite ends coupled to the respective lower ends of the piston rods. A mandrel plate is fixed for rotation with the lower shaft and is adapted for having various core handling attachments releasably secured thereto. A stop mechanism stop plate is fixed for rotation with the upper shaft and a stop pin is selectively insertable through upper and lower tubular receptacles provided in the upper end portion of the frame so as to respectively cooperate with first and second pairs of adjustable abutment surfaces of the stop plate so as to limit to amount of rotation of the upper shaft respectively to about 90° and 180° and hence to similarly limit the range of rotation of the lower shaft and mandrel plate, whereby an operator controlling reciprocation of the air cylinders will be aided by the stop structure in effecting precise positioning of a core handling attachment relative to or together with a core to be or being handled.

16 Claims, 6 Drawing Sheets

Fig. 3
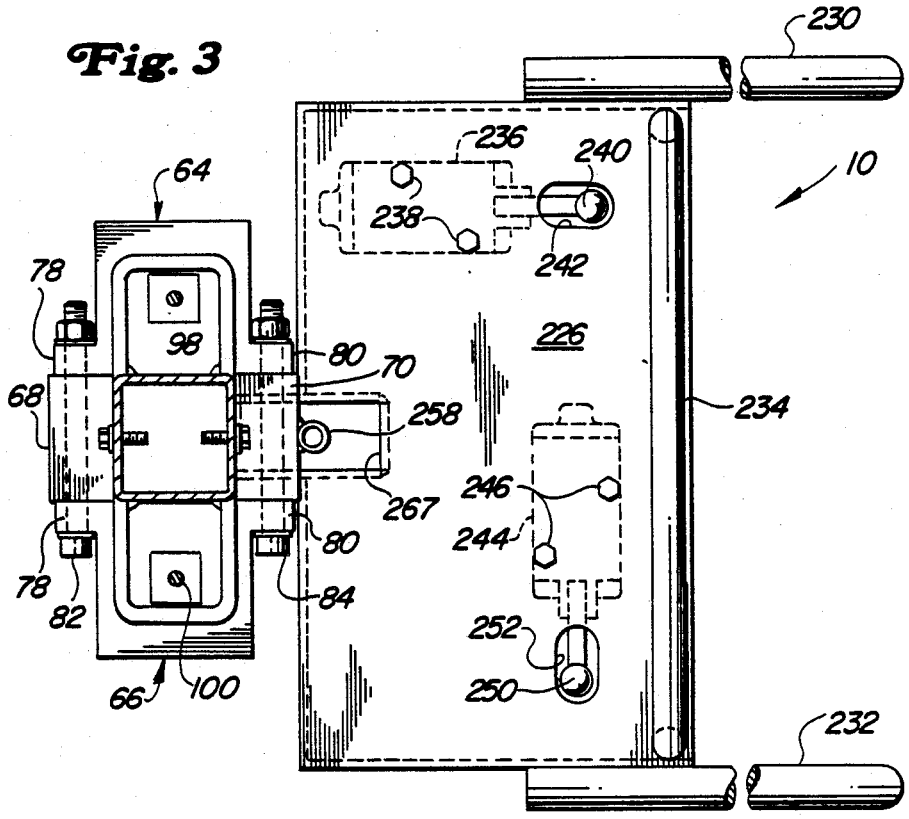
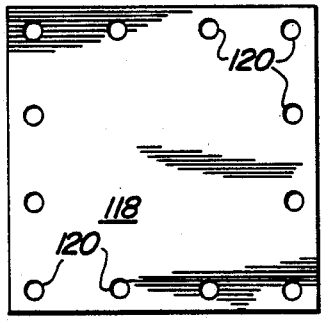
Fig. 5
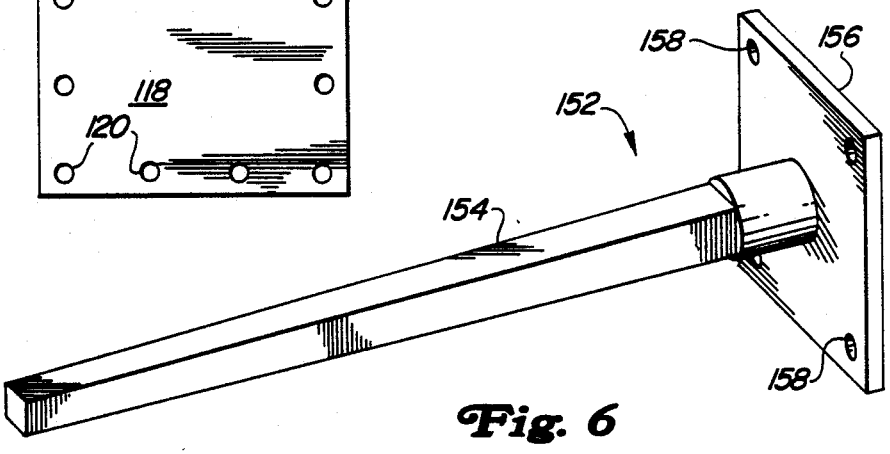
Fig. 6

CORE HANDLING APPARATUS

BACKGROUND OF THE INVENTION

The present invention relates to apparatus for handling foundry sand cores and more particularly relates to hoist-hung devices which can be clamped on or otherwise secured to a core requiring handling during the process of preparing the core for placement in a mold.

In order to improve the finish on casting surface, cores are often coated or washed with a refractory slurry which is then dried onto the core surface. One way of applying the wash to the core is by dipping the core in a vat containing the slurry. The afore-mentioned hoist-hung devices are used to perform the dipping function and the devices are often provided with structure whereby the core may be rotated either manually or mechanically after being dipped so that excess wash drains from the upper surfaces of the core.

A known hoist-hung device having provision for manually rotating a core includes a pair of limbs which straddle the core and are provided with fixtures which engage opposite sides of the core and define a pivot axis about which the core may be rotated. Two people, one grasping each limb, are required to manually engage and flip or turn over the core between the limbs. This can be a difficult and dangerous practice, especially when handling cores having a large mass which becomes unbalanced relative to the pivot axis when the core is being turned over since the core may slip from the control of the workers and cause injury to them as it falls out of control. Also, the core can be damaged under these circumstances.

Another drawback of this known hoist-hung device is that it is more or less dedicated to handling a single family of cores because of the spacing of the limbs and the need to engage opposite sides of the cores.

Some of the drawbacks of the above-described devise; i.e, the requirement for two people, manual roll over and the danger or possible core damage associated with the manual roll over operation, are overcome by known devices which include power means for pivoting or rolling over the core. One such known device includes a pair of double acting, air-operated vane type actuators located on opposite sides of and having respective output shafts connected to an arbor structure for swinging the latter through 90°, the arbor structure being engageable with a core so as to swing the latter with it. This device has the disadvantages of being dedicated to handle only one core and thus not being adaptable for having different core-engaging attachments secured thereto and of being swingable only up to 90°.

SUMMARY OF THE INVENTION

According to the present invention, there is provided an improved hoist-hung foundry core handling device including a powered means for rotating a core.

A broad object of the invention is to provide a core handling device which overcomes the above-noted drawbacks of known handling devices having either manual or power rotated fixtures for swinging the core about a pivot axis.

A more specific object is to provide a core handling device including a power-rotatable mandrel adapted for having different core engaging attachments or fixtures connected thereto, the fixtures being adaptable for engagement with respective cores from one side of the cores.

Yet another specific object is to provide a core handling device including a power-rotatable mandrel and means associated with the drive for the mandrel for delimiting the range of its movement such that the mandrel may be precisely positioned for engaging a given fixture with a core to be handled without relying on the skill or attention of an operator.

These and other objects of the invention will become more apparent upon reading the ensuing description together with the appended drawings.

BRIEF DESCRIPTION OF THE DRAWINGS

FIG. 3 is a top view of control panel.

FIG. 5 is a front view of the rotary mandrel support plate to which interchangeable core handling attachments may be bolted.

FIG. 6 is a core handling attachment in the form of a tapered spike of rectangular cross-section.

DESCRIPTION OF THE PREFERRED EMBODIMENT

Figure 1:
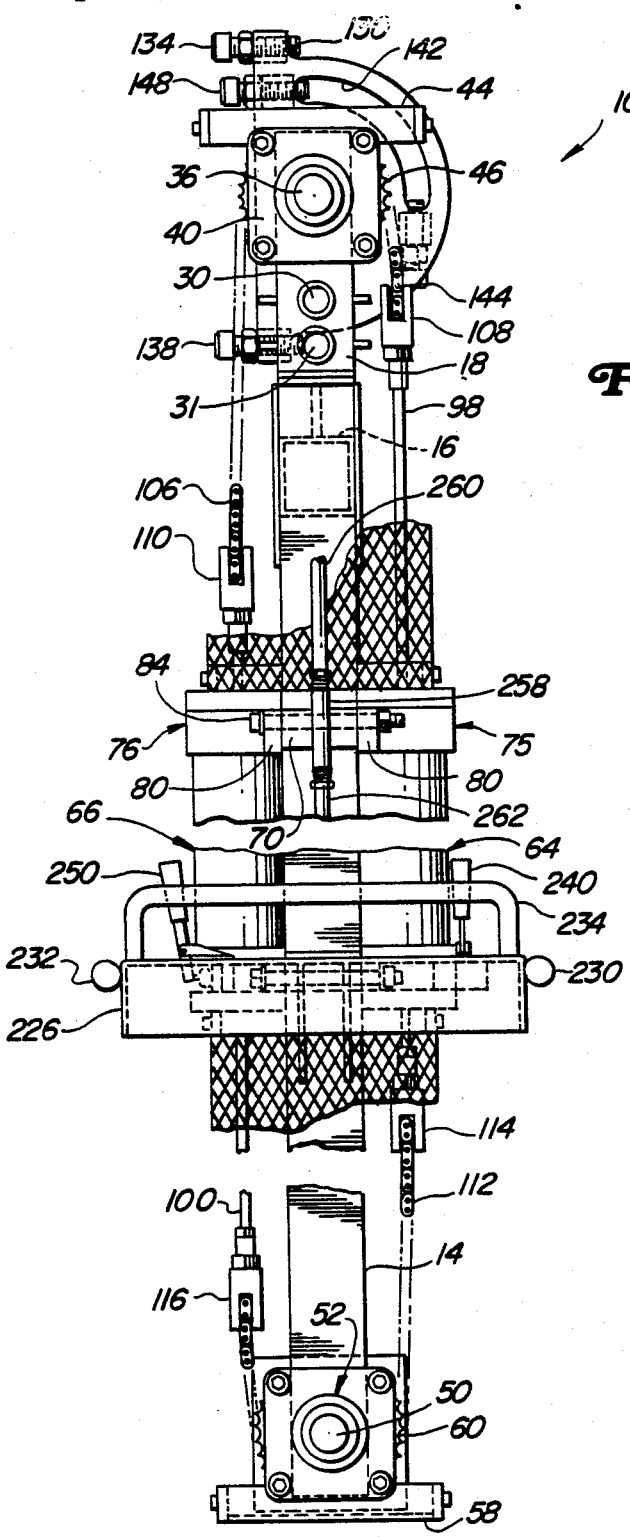
FIG. 1 is a rear elevational view of a core handling apparatus constructed in accordance with the principles of the present invention.

The terms front, rear, left, etc. used herein are from the perspective of an operator facing controls carried at one side of the core handling apparatus with the one side being considered the rear of the apparatus.

Referring to FIGS. 1–4 of the drawing, there is shown a core handling apparatus 10 of a type adapted to be hung from a hoist. Specifically, the apparatus 10 includes a main frame 12 defined by a vertical tubular section 14 and a horizontal tubular section 16 having its rear end fixed, as by welding, to a forward side location of the section 14 just below a removable top portion 18 of the latter, whereby the section 16 is cantilevered from the section 14. Extending centrally along the top of and being welded to the horizontal tubular section 16 is a hoist eyelet plate 20 provided with a series of apertures 22 spaced lengthwise therealong and providing alternate connection points for a clevis 24 adapted for having an overhead hoist hook engaged therewith.

The top portion 18 of the vertical frame section 14 is provided with a horizontal rectangular mounting plate 26 at its lower end which is bolted to a similar plate 28 provided at the top of the remainder of the section 14. Upper and lower stop pin receptacles 30 and 31 are respectively defined by parallel upper and lower fore-and-aft disposed tubes extending horizontally through the top portion 18 of the frame section 14 at a zone just above the mounting plate 26. The rear end portion of the tubes are welded to the, backside of the frame portion 18 while an upper set of gusset plates is welded opposite sides of the upper tube and to the frame portion 18 and a lower set of gusset plates is welded to opposite sides of the lower tube and to the frame portion 18. A stop pin 34 is selectively insertable through the receptacles 30 or 31 for a purpose explained below. An upper sprocket shaft 36 is rotatably supported in fore-and-aft spaced bearings 38 having respective mounting flanges 40 bolted to respective bearing mounting plates 42 welded to opposite front and rear faces of the frame top portion 18 and to which a top end cap 44 is welded. An upper sprocket 46 is mounted on the upper shaft 36 with opposite peripheral portions of the sprocket extending through respective cut-out areas 48 provided in opposite side faces of the top frame portion. A lower sprocket support shaft 50 is similarly rotatably supported in fore-and-aft spaced bearings 52 having respective flanges 54 bolted to respective bearing mounting plates 56, welded to opposite front and rear faces of a lower end of the vertical frame section 14, and to which a bottom end cap 58 is welded. A lower sprocket 60 is mounted on the lower shaft 50 with opposite peripheral portions of the sprocket extending through respective cut-out areas 62 provided in opposite side faces of the frame section 14.

Supported at a midsection of vertical frame section 14 are right and left air cylinders 64 and 66, respectively. Specifically, a rear set of upper and lower cylinder mounting blocks 68 and 70 are welded to the rear side of the vertical frame section 14 and a front set of upper and lower cylinder mounting blocks 72 and 74 are welded to the front side of the frame section at respective positions directly opposite from the blocks 68 and 70. The upper blocks 68 and 72 are each provided with a horizontal transverse bore and the upper ends of the cylinders 64 and 66 are respectively defined by end caps 75 and 76 each having a pair of apertured mounting ears 78 and 80 with the ears 78 engaging opposite sides of and being clamped to the upper rear mounting block 68 by a bolt and nut assembly 82 and with the ears 80 engaging opposite sides of and being clamped to the upper front mounting block 72 by a bolt and nut assembly 84. Similarly, the lower blocks 70 and 74 are each provided with a horizontal transverse bore and the lower ends of the cylinders 64 and 66 are respectively defined by end caps with only the end cap 88 of the right cylinder 66 being shown, and each end cap having a pair of apertured mounting ears 90 and 92 with the ears 90 engaging opposite sides of and being clamped to the lower rear mounting block 70 by a bolt and nut assembly 94 and with the ears 92 engaging opposite sides of and being clamped to the lower front mounting block 72 by a bolt and nut assembly 96. The cylinders 64 and 66 respectively include piston rods 98 and 100 having respective pistons 102 and 104 (FIG. 8) located centrally along the length of the rods. An upper length of roller chain 106 is engaged with the upper sprocket 46 and has its opposite ends respectively pinned to clevises 108 and 110 respectively carried by upper ends of the rods 98 and 100. Similarly, a lower length of roller chain 112 is engaged with the lower sprocket 60 and has its opposite ends respectively pinned to clevises 114 and 116 respectively carried by lower ends of the rods 98 and 100. As can best be seen in FIG. 1, the rod 98 of the right cylinder 64 is shown in its full up position while the rod 100 of the left cylinder 66 is shown in its full down position. Thus, it will be appreciated that by simultaneously connecting air pressure to the top of the piston 102 carried by the rod 98 and to the bottom of the piston 104 carried by the rod 100 while simultaneously venting the spaces below and above the pistons 102 and 104, respectively, the rod 98 will move downwardly while the rod 101 moves upwardly thus effecting clockwise rotation of the upper and lower sprockets 46 and 60 and hence of the upper and lower shafts 36 and 50.

A mandrel 118, in the form of a square plate, has a centrally located hole passing therethrough and is welded to a forward end of the lower shaft 50 which is received in the hole whereby the mandrel rotates with the shaft. A plurality of the threaded holes 120 are provided in the mandrel 118 and are arranged in a square pattern having the shaft 50 at its center. Interchangeable core handling attachments, examples of which are described below, are adapted to be bolted to the mandrel.

The rotation imparted to the mandrel 118 by actuation of the cylinders 64 and 66 is precisely controlled by a stop mechanism (FIG. 4) including a rotation limiting plate 122 mounted to a forward end of the upper shaft 36 for rotation therewith. Specifically, the plate 122 is substantially hemispherical in shape and includes a hub 124 received on and fixed to the shaft by a keyway and set screws (not shown) received in threaded holes offset 90° from each other in the hub 124. The plate 122, as viewed in FIG. 4, has a central peripheral surface 128 curved arcuately about the shaft 36 through an angle somewhat more than 180° and having opposite ends respectively terminating at upper and lower vertically and oppositely extending tab-like projections 130 and 132, respectively. The radial distance of the surface 128 from the axis of the shaft 36 is such that when the pin 34 is received in the receptacle 31 a forward-end portion of the pin will extend past the plate 122 adjacent the surface 128 and will be disposed in the path of movement of the projections 130 and 132 so as to limit the rotation of the plate 122 and, hence the mandrel 118 to about 180°. Precise adjustment of the amount of allowable rotation is provided by an upper stop screw 134 adjustably, threadedly received in an upper block 136 welded to a forward surface of the upper projection 130 and located such that an end of the screw 134 will engage the pin 34 to limit clockwise rotation of the plate 122, as viewed in FIG. 1. Counterclockwise rotation of the plate 122 is similarly limited by a lower stop screw 138 adjustably threadedly received in a lower block 140 welded to a forward surface of the lower projection 132.

In some situations, it may be desirable to limit the rotation of the mandrel 118 to about 90°. This is accomplished by an arcuate slot 142 of slightly more than 90° in length provided in the plate 122 in parallel relationship to a portion of the arcuate surface 128 extending from the upper projection 130. The radial distance of the slot 142 from the axis of the shaft 36 is chosen such that the forward end portion of the pin 34 will project through the slot in the vicinity of the right end thereof, as viewed in FIG. 1, when the pin is inserted through the upper receptacle 30, such insertion being possible when the piston rods 98 and 100 are respectively centered within the cylinders 64 and 66. Precise adjustment of the amount of allowable rotation is provided by a stop screw 144 adjustably threadedly received in a block 146 welded to the forward face of the plate 122 in alignment with that end of the slot 142 which is remote from the projection 130 and by a stop screw 148 adjustably threadedly received in a block 150 welded to the forward face of the plate 122 in alignment with that end of the slot 142 which is adjacent to the projection 130.

Referring now to FIG. 6, there is shown one type of core handling attachment or fixture 152 formed by an elongate tapered spud 154 preferably of rectangular of square cross section and having its longer end welded to a central location of one side of a square mounting plate 156 having mounting holes 158 arranged in a pattern to match up with some of the holes 120 provided in the mandrel plate 118 whereby the attachment 152 may be releasably bolted to the mandrel plate. The spud 154, when mounted to the mandrel plate 118 as viewed in FIG. 1, would extend horizontally and be adapted for insertion into a complimentary shaped, horizontal receptacle provided in one side of a sand core to be handled by the core handling apparatus 10.

Figure 7:
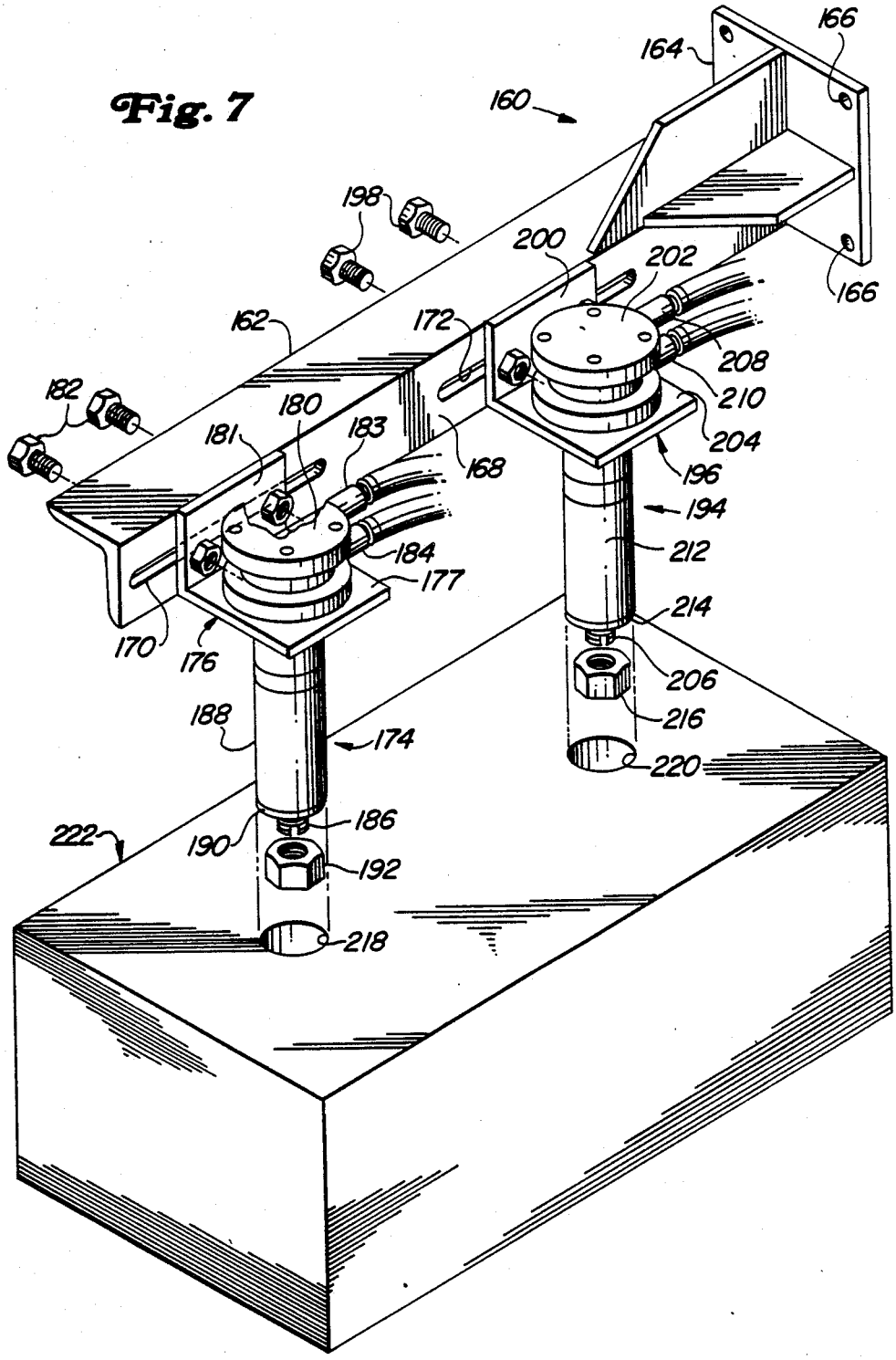
FIG. 7 is another core handling attachment including a pair of air arbors releasably secured to an angular support.

Referring now to FIG. 7, there is shown another core handling attachment 160 of a type utilizing air arbors for releasably engaging sand cores. Specifically, the attachment 160 includes an arbor support beam 162 formed from an angle iron having an end welded to a central location of a forward face of a mounting plate 164 provided with four mounting holes 166 arranged for matching up with four of the holes 120 provided in the mandrel plate 118 whereby the beam 162 may be releasably bolted to the plate 118. The beam 162 has a vertical flange 168 in which front and rear horizontal elongate slots 170 and 172, respectively, are located. An air arbor assembly 174 includes an L-shaped mounting bracket 176 having a horizontal leg 177 located beneath a cylinder 180 and a vertical leg 181 mounted to the beam 162 by a pair of bolts 182 extending through the front slot 170. A piston (not shown) is located in the cylinder 180 with air fittings and 180, respectively, being located above and below the piston. A piston rod 186 has its upper end fixed to the cylinder and has an elastomeric sleeve 188 received thereon and held in place by a washer 190 held against the bottom thereof by a nut 192. By routing air into the fitting 184 while coupling the fitting 182 to exhaust, the rod 186 will be retracted to thus cause the sleeve 188 to be squeezed resulting in the latter bulging outwardly. A second air arbor assembly 194, constructed identically to the assembly 174, includes an L-shaped mounting bracket 196 mounted to the beam 162 by a pair of bolts 198 inserted through the rear slot 172 and vertical leg 200 of the bracket. A cylinder 202 is supported by a horizontal leg 204 of the bracket and located in the cylinder is a piston (not shown) to which a vertically extending piston rod 206 is fixed. The cylinder contains upper and lower air passage respectively coupled to upper and lower air fittings 208 and 210 and opening into the cylinder above and below the piston. An elastomeric sleeve 212 is received on the rod 206 and a washer 214 is held against the bottom of the sleeve by a nut 216 screwed onto a threaded lower end of the rod 206.

Located below the arbor assemblies 174 and 194 and containing respective vertical holes 218 and 220 for receiving the sleeves 188 and 212 of the arbor assemblies is a sand core 222 the holes 218 and 220 being sized just slightly larger than the unexpanded diameter of the sleeves.

Thus, once inserted into the holes 218 and 220 and expanded, the sleeves 188 and 212 will grip the sand core to permit the latter to be handled by the apparatus 10.

While the air arbor assemblies 174 and 194 are here illustrated as being identical, it is to be understood that the respective piston rods could be of different lengths for insertion into core holes of different depth as may be the case with irregular sized cores. Also, the assemblies 174 and 194 are shown engaging only a single core 222, however, by using longer rods, at least two cores 222 may be stacked one on the other with the pistons extending through the upper most core or cores and with the expandable sleeves being positioned for engaging the lower most core whereby multiple cores may be handled at the same time.

Figure 2:
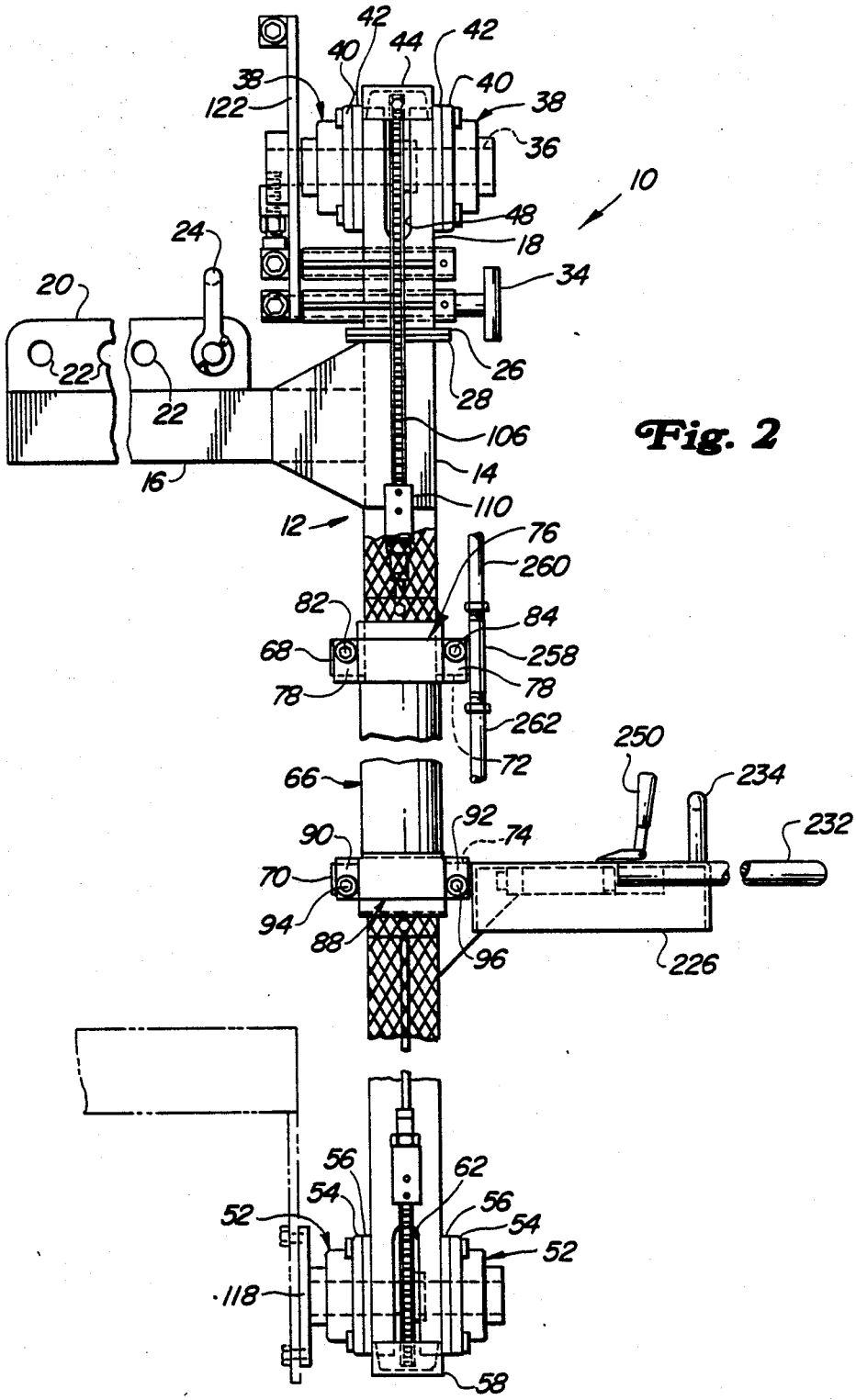
FIG. 2 is a left-side elevational view of the core handling apparatus shown in FIG. 1.
Figure 4:
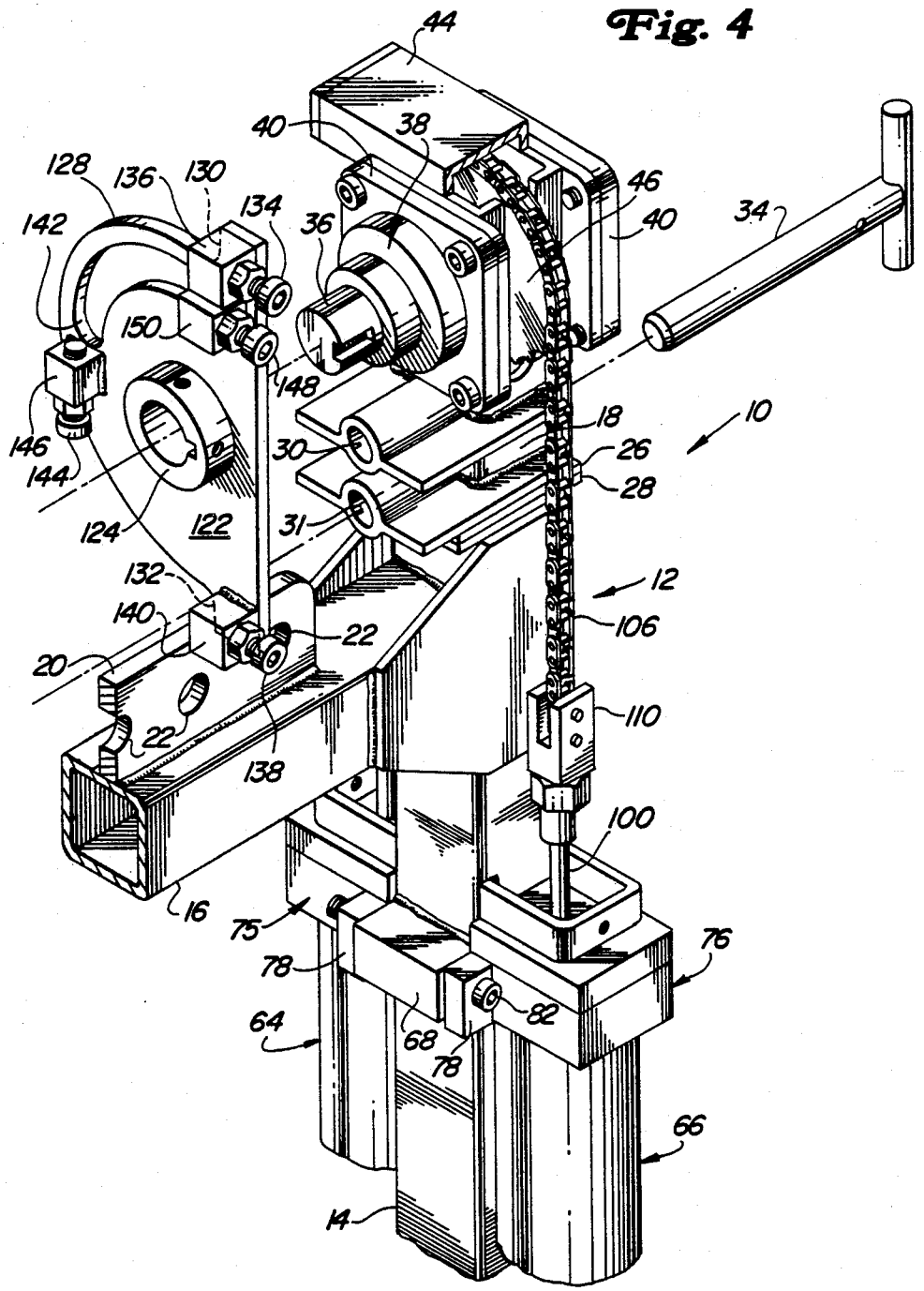
FIG. 4 is a partially exploded, left front perspective view of the upper end portion of the core handling apparatus showing the stop mechanism for controlling the range of movement of the rotary mandrel of the core handling apparatus.

Referring now back to FIGS. 1–3 and also to FIG. 7, the means for controlling the core handling apparatus 10 will be described. Specifically, a control panel 226 which is rectangular in top view (FIG. 3) is mounted to the back side of the vertical frame section 14 by a pair of parallel gusset plates 228 welded to a central front underside location of the panel and to the frame section 14. Right and left hand grips 230 and 232 are respectively fixed to right and left sides of and project rearwardly from the panel 226. A central, inverted U-shaped hand grip 234 has its opposite ends respectively welded to the top of the panel at rear corners of the latter.

An air arbor control valve 236 has a housing mounted to a right hand underside location of the panel 226 by a pair of screw fasteners 238. The valve 236 is oriented such that a valve element 239 thereof will be shifted fore-and-aft by fore-and-aft movement of a control lever 240 which is coupled to the element 239 and projects upwardly through an opening 242 provided in the panel.

A mandrel rotation control valve 244 has a housing mounted to a left rear underside location of the panel 226 by a pair of screw fasteners 246. The valve is oriented such that a valve element 248 thereof will be shifted sideways or left and right by left and right movement of a control lever 250 which is coupled to the element 248 and projects upwardly through an opening 252 provided in the panel.

The valves 236 and 244 are each 4-way, five port, two position control valves and are coupled in parallel with each other to a main source of shop air 254 by a supply line 256. The line 256 includes a nipple 258 disposed vertically and mounted to the backside of the vertical frame section 14. A flexible air supply hose 260 having a length sufficient to permit unrestrained movement of the apparatus 10 is connected to the top of the nipple 258 while a length of hose 262 is coupled to the bottom of the nipple 258 and to appropriate plumbing (not shown) coupled to respective inlets of the valves 236 and 334.

First and second supply-return hoses 264 and 266 are respectively coupled to first and second supply-return ports of the arbor control valve 236, extend upwardly through an opening 267 provided in a central front location of the panel and terminate in first and second quick-connect couplings 268 and 270. A first pair of restricted bleed lines 272 and 274 are respectively coupled to a first pair of exhaust ports located on opposite sides of the valve inlet. The upper fittings of the arbor assemblies 174 and 194 are plumbed in parallel to a first air hose 276 having a quick-connect coupling 278 releasably coupled to the quick-connect coupling 268. Similarly, the lower fittings of the arbor assemblies 174 and 194 are plumbed in parallel to a second air hose 280 having a quick-connect coupling 282 releasably coupled to the quick-connect coupling 270. The hoses 276 and 280 are each of a length permitting free movement of the core handling attachment 160 during oscillation of the mandrel 118 through operation of the cylinders 64 and 66.

Third and fourth supply-return hoses 284 and 286 are respectively coupled to third and fourth supply-return ports of the mandrel control valve 244 and extend upwardly through the opening 287, the hose 284 being plumbed to the top of the right hand cylinder 64 and to the bottom of the left hand cylinder 66 and the hose 286 being plumbed to the bottom of the right hand cylinder 64 and to the top of the left hand cylinder 66. A second pair of restricted bleed lines 288 and 290 are respectively coupled to a second pair of exhaust ports located at opposite sides of the inlet of the valve 244.

The operation of the core handling apparatus 10 is briefly as follows: Assuming that it is desired to dip in a core wash or dressing or otherwise handle a sand core provided at one of its sides with a horizontal hole shaped complimentary to the spud 154 of the core handling attachment 152, the core handling apparatus 10 will be equipped with the attachment 152 by bolting the plate 156 onto the rotary mandrel 118. An operator will then control an overhead crane to raise or lower the apparatus 10 and manipulate the apparatus 10 through the grips 230–234 to insert the spud 154 into the hole provided in the core. The crane will then be controlled to effect lifting of the apparatus 10 plus the engaged core. If the lifted load appears to be too unbalanced relative to the point of attachment of the clevis with the hoist eyelet plate 20, the clevis may be appropriately moved to a different attachment hole 22. Once the desired weight balance is achieved, the core is lifted by the overhead hoist and lowered into a dip tank filled with wash material. The hoist is then operated to raise the core from the dip tank. Assuming that the core is of a configuration requiring it to be inverted in order to drain excess wash therefrom, the stop pin 34 will be inserted through the receptacle 31 so as to limit rotation of the plate 122 and hence the mandrel plate 118 to about 180°. Drainage of such excess wash is then accomplished by pivoting the valve control lever 250 rightwardly, as viewed in FIG. 1, so as to shift the valve element 248 rightwardly and thereby connect the source of air pressure 254 respectively to the top and bottom of the cylinders 64 and 66 while respectively coupling the bottom and top of the cylinders 64 and 66 to the restricted exhaust line 288. The piston rods 98 and 100 will then lower and raise respectively to effect clockwise rotation of the sprockets 46 and 50 and of the stop plate 122 and mandrel 18. Such rotation of the stop plate 122 will cease upon the stop screw 134 coming into engagement with the pin 34 whereupon the valve control lever 250 may be pivoted back to the left so as to reverse the connections of the top and bottom ends of the cylinders 64 and 66 with the source and exhaust lines so as to effect upward movement of the rod 98 and downward movement of the rod 100 and hence counterclockwise rotation of the sprocket 46 and 50 and of the stop plate 122 and mandrel 188, the later rotation ceasing upon the stop screw 138 coming into engagement with the pin 34.

In the event the core to be handled is configured such that only about 90° rotation is required to drain excess core wash from the top thereof, the pin 34 will be inserted through the upper receptacle 30 once the valve control lever 250 has been moved to effect shifting of the valve element 248 to control operation of the cylinders 64 and 66 so as to turn the plate 122 sufficiently to align the opening 142 with the receptacle 30. The pin 34 then extends through the opening 142 so as to be positioned for engagement by the screws 144 and 148 which respectively limit counterclockwise and clockwise rotation of the plate 122, as viewed in FIG. 1.

Assuming the core to be handled is of such a size and configuration that movement thereof is best accomplished using the core handling attachment 160, the latter will be mounted to the mandrel plate 188 and the core will be provided with vertical holes 218 and 220 sized for respectively receiving the expansible sleeves 188 and 212 of the front and rear air arbor assemblies 174 and 194. The quick coupler connections 270 and 282 respectively at the ends of the hoses 266 and 280 will be interconnected to thereby establish a connection of the arbor control valve 236 with the lower fittings 184 and 210 of the arbor assemblies 174 and 194. Similarly, the quick coupler connections 268 and 278 respectively at the ends of the hoses 264 and 276 will be interconnected to thereby establish a connection of the arbor control valve 236 with the upper fittings 183 and 208 of the arbor assemblies 174 and 194.

Figure 8:
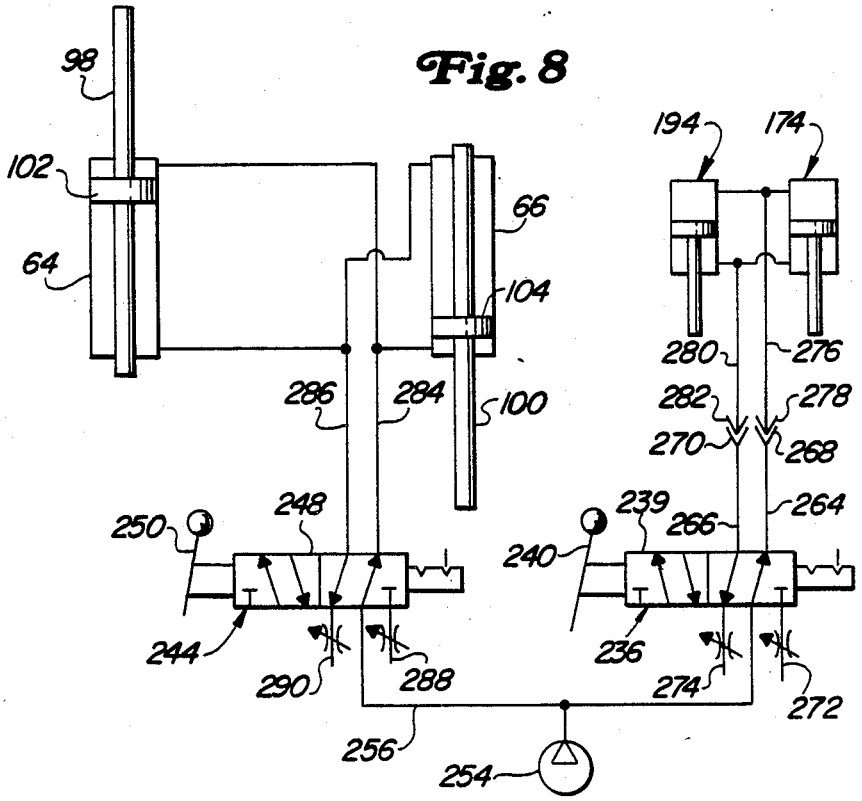
FIG. 8 is a schematic representation of the circuitry for controlling the delivery of air to and the return of air from the air cylinders for rotating the rotary mandrel and the arbor air cylinders for effecting their engagement with and release from a core to be handled.

The selection of 90° or 180° rotation of the mandrel will be made as discussed above. Engagement of the attachment 160 with a core 222 will be accomplished by lowering the apparatus 10 through use of an overhead hoist and guiding the arbor sleeves 188 and 212 into the holes 218 and 220, respectively, with the valve control lever 240 being in its rearward arbor, disengage position, as shown in FIG. 8, wherein the valve element 239 is positioned for connecting the upper ends of the arbor cylinders to the source of air 254 so that the rods 186 and 206 are extended and the sleeves 188 and 212 are unexpanded. Once the sleeves 188 and 212 are located within the holes 218 and 220, the core 222 is "locked" onto the attachment by effecting expansion of the sleeves by pushing forward on the control lever 240 so as to shift forwardly the valve element 239 of the arbor control valve 236 and connect air pressure to the bottom of the arbor cylinders, causing the piston rods 186 and 206 to retract and compress the sleeves 188 and 212 through means of the washers 190 and 214. The core 222 may then be handled as in the manner described above in conjunction with the core handling attachment 152.

I claim:

1. A core handling apparatus comprising: an upright main frame; means for suspending the frame in an upright orientation from an overhead hoist; upper and lower, parallel shafts rotatably mounted to said frame; drive means coupled between the shafts for effecting simultaneous oscillation thereof; a mandrel plate being fixed to said lower shaft for oscillation therewith; a core handling attachment releasably secured to said mandrel plate; and a stop means including (a) a first member fixed to said upper shaft for oscillation therewith and including a first pair of abutment surfaces located at a first radial distance from the upper shaft and being spaced apart a first angular distance from each other about the upper shaft, and a second pair of abutment surfaces located at a second radial distance from the upper shaft and being spaced apart a second angular distance from each other about the upper shaft, and (b) a second member adjustably mounted to said frame for being selectively positionable either in a first location between and in the path of movement of the first pair of abutment surfaces or in a second location between and in the path of movement of the second pair of abutment surfaces whereby the range of oscillation of the lower shaft and hence the mandrel plate and core handling attachment is delimited so as to aid an operator in controlling the positioning of an engaged core.

2. The core handling apparatus defined in claim 1 wherein said first pair of abutment surfaces are spaced angularly part by about 180° and said second pair of abutment surfaces are spaced angularly apart by about 90°.

3. The core handling apparatus defined in claim 1 or 2 wherein at least one of each of the first and second pairs of abutment surfaces is adjustable.

4. The core handling apparatus defined in claim 3 wherein said one of each of the first and second abutment surfaces is in the form of a screw having an end disposed for engagement with said second member.

5. The core handling apparatus defined in claim 1 wherein said first member is in the form of a plate having a hub received on the upper shaft and having an outer surface extending arcuately about said upper shaft between said first pair of abutment surfaces and having a slot located radially inwardly of said outer surface and extending arcuately about said upper shaft between said second pair of abutment surfaces; and said second member when located in its first position projecting from the frame to a location beside said outer surface of said plate and when located in its second position projecting from the frame to a location within said slot.

6. The core handling apparatus defined in claim 5 wherein upper and lower tubular receptacles are fixed to the frame respectively at an upper location spaced radially from the upper shaft by a distance equal to the spacing of the slot from the upper shaft, and at a lower location spaced radially from the upper shaft by a distance slightly greater than the spacing of the outer surface of the plate from the upper shaft; and said second member being in the form of a pin having a length greater than that of the tubular receptacles so that when the pin is inserted through the lower receptacle an end portion thereof will be located beside the outer surface of the plate and in the path of movement of the first pair of abutment surfaces, and so that when the pin is inserted through the upper receptacle the end portion of the pin will be received in the slot of the plate and in the path of movement of the second pair of abutment surfaces.

7. The core handling apparatus defined in claim 6 wherein at least one of each of the first and second pairs of abutment surfaces is adjustable.

8. The core handling apparatus defined in claim 1 wherein said drive means includes upper and lower sprockets respectively fixedly mounted on the upper and lower shafts for imparting rotation thereto; roller chain means engaged with the upper and lower sprockets; a linearly reciprocable actuator means connected between the frame and the roller chain means for moving the latter in opposite first and second directions respectively in response to reciprocation of the actuator means in said opposite first and second directions; and control means connected to the actuator means for selectively effecting reciprocation of the actuator means in opposite directions.

9. The core handling apparatus defined in claim 1 wherein said actuator means includes at least one air cylinder fixed to the frame and containing a piston mounted centrally along a piston rod having opposite ends attached to said roller chain means; and said control means including a source of air pressure and a control valve connected to the source by a supply line and to opposite ends of the air cylinder respectively by a pair of supply-return lines; said control valve including an element shiftable between a first position wherein air is routed to one end of the air cylinder from the source while air is routed from the other end of the air cylinder to an exhaust port and a second position where air is routed to said other end of the air cylinder from the source while air is routed from said one end of the cylinder to another exhaust port.

10. The core handling apparatus defined in claim 9 wherein a control panel is mounted to said frame; and said control valve being mounted to said control panel.

11. The core handling apparatus defined in claim 9 wherein said actuator means includes a second air cylinder fixed to the main frame and containing a second piston mounted centrally along a second piston rod; said roller chain means including an upper length of chain engaged with the upper sprocket and having opposite ends respectively connected to upper ends of the first mentioned and second piston rods and a lower length of chain engaged with the lower sprocket and having opposite ends respectively connected to lower ends of the first mentioned and second piston rods; and said pair of supply-return lines being connected to the opposite ends of the second cylinder such that the upper and lower ends respectively of the first-mentioned and second air cylinders are connected in communication with each other while the lower and upper ends respectively of the first-mentioned and second air cylinders are connected in communication with each other whereby the control valve will effect simultaneous opposite movement of the first-mentioned and second pistons.

12. The core handling apparatus defined in claim 1 wherein the core handling attachment includes a mounting plate releasably secured to said mandrel plate and an elongate tapered spud cantilevered horizontally from said mounting plate.

13. The core handling apparatus defined in claim 1 wherein the core handling attachment includes a mounting plate releasably secured to said mandrel plate; a beam cantilevered horizontally from the mounting plate; at least one air-operated arbor having a vertically oriented cylinder mounted to said beam and containing a piston mounted to a vertically projecting piston rod; an expansible elastomer sleeve carried by said rod between an abutment and a washer mounted on the rod whereby upward shifting of the rod will cause he sleeve to be compressed and expanded; and air control circuit means including an arbor control valve coupled to opposite ends of the arbor piston respectively by a pair of supply-return lines and to a source of pressurized air by a supply-line; the arbor control valve including a shiftable element movable between a first position for routing air from the source to the top of the arbor cylinder while connecting the bottom of the arbor cylinder to an exhaust port so as to effect extension of the piston rod and a second position for routing air from the source to the bottom of the arbor cylinder while connecting the top of the arbor cylinder to another exhaust port so as to effect contraction of the piston rod and expansion of the sleeve through compression of the sleeve whereby a core received on the sleeve prior to its expansion will be gripped after its expansion.

14. The core handling apparatus defined in claim 13, wherein a second arbor identical in construction to said at least one arbor is mounted to said beam and has upper and lower ends of its cylinder connected in parallel with the upper and lower ends of the cylinder of said at least one arbor.

15. In a core handling apparatus including an upright frame, a reversible powered drive means including a horizontal rotatable shaft means supported by a lower end portion of the frame and oscillatable through operation of the drive means, and a core handling attachment secured to the shaft means for oscillating therewith, the improvement comprising: stop means carried by the frame and including first and second members, said first member forming part of said drive means and being mounted and connected for rotation in concert with said shaft means; said first member including first and second pairs of abutment surfaces spaced radially from each other relative to an axis of rotation of the first member with the abutment surfaces of each pair being spaced angularly from each other about said axis; and said second member being selectively mountable to said frame in either a first location wherein it is located between and in the path of movement of the first pair of abutment surfaces or in second location wherein it is located between and in the path of movement of the second pair of abutment surfaces.

16. The core handling apparatus defined in claim 15 wherein said horizontal shaft means includes a first shaft rotatably mounted in the frame and said drive means includes a second shaft arranged parallel to and above said first shaft, a drive sprocket mounted on each of the first and second shafts, a powered reciprocal actuator having a cylinder fixed to the frame in an upright disposition and containing a reciprocable piston mounted centrally along a piston rod, motion transfer means including roller chain means engaged with the pair of sprockets and connected to opposite ends of said piston rod whereby upward movement of the piston rod will effect concurrent rotation of the sprockets in a first direction and downward movement of the piston rod will effect concurrent rotation of the sprockets in a second direction opposite to the first direction; and said first member being mounted for rotation with the second shaft.

* * * * *